US010390629B2

(12) United States Patent
Phillips et al.

(10) Patent No.: US 10,390,629 B2
(45) Date of Patent: Aug. 27, 2019

(54) MOVE AND DISCOVER CHAIR

(71) Applicants: Frank Phillips, Evergreen, CO (US); Kristina Elizabeth Scala, Littleton, CO (US)

(72) Inventors: Frank Phillips, Evergreen, CO (US); Kristina Elizabeth Scala, Littleton, CO (US)

( * ) Notice: Subject to any disclaimer, the term of this patent is extended or adjusted under 35 U.S.C. 154(b) by 0 days.

(21) Appl. No.: 15/787,489

(22) Filed: Oct. 18, 2017

(65) Prior Publication Data

US 2019/0110608 A1 Apr. 18, 2019

(51) Int. Cl.

| | |
|---|---|
| ***A47D 1/08*** | (2006.01) |
| ***A47D 11/00*** | (2006.01) |
| ***A47C 13/00*** | (2006.01) |
| ***A47C 7/72*** | (2006.01) |
| ***A47D 15/00*** | (2006.01) |

(52) U.S. Cl.

CPC ..... *A47D 1/08* (2013.01); *A47D 15/00* (2013.01)

(58) Field of Classification Search

CPC ..... A47D 1/08; A47D 15/00
USPC ..... 297/3, 217.4, 217.6, 462
See application file for complete search history.

(56) References Cited

U.S. PATENT DOCUMENTS

| | | | | | |
|---|---|---|---|---|---|
| 902,395 | A | * | 10/1908 | Haley | A47D 1/04 297/3 |
| D144,404 | S | * | 4/1946 | Mabry | 297/3 |
| D147,581 | S | * | 9/1947 | Coulter | 297/3 |
| 2,440,979 | A | * | 5/1948 | Schneider | A47D 1/04 297/3 X |
| 2,776,700 | A | * | 1/1957 | Potter | A47C 4/021 297/3 X |
| 3,556,586 | A | * | 1/1971 | Beardmore | A47B 83/02 297/3 X |
| 3,650,563 | A | | 3/1972 | Hansson et al. | |
| 4,205,876 | A | * | 6/1980 | Cetina | A47D 1/00 297/3 X |
| 4,565,403 | A | * | 1/1986 | Brown | A47B 83/02 297/3 X |

(Continued)

FOREIGN PATENT DOCUMENTS

KR 2003-0019492 A 3/2003

OTHER PUBLICATIONS

International Search Report and Written Opinion of PCT/US2018/056594 dated Jan. 8, 2019, 9 pp.

*Primary Examiner* — Rodney B White
(74) *Attorney, Agent, or Firm* — Lathrop Gage LLP

(57) ABSTRACT

A move and discover chair helps teachers transition to new education paradigm where children "move" and "discover" education with the teacher positioned in the midst of the children to encourage them in the excitement of learning. The chair stimulates the ability to focus on learning and to be more effective in one's work by allowing some level of movement, balance, fidgeting, and engagement with the background environment. The chair includes a concave end cap with a first side edge and an external concave surface, a convex end cap with a second side edge and an external convex surface, and a center section fixedly positioned between the concave end cap and the convex end cap and with an outer surface that is substantially straight in a directions between the concave end cap and the convex end cap.

8 Claims, 11 Drawing Sheets

(56) References Cited

U.S. PATENT DOCUMENTS

| | | | | | |
|---|---|---|---|---|---|
| 4,593,950 | A | * | 6/1986 | Infanti | A47C 3/029 297/3 X |
| 4,618,183 | A | * | 10/1986 | Bauer | A47C 13/00 297/3 X |
| 4,763,580 | A | * | 8/1988 | Garland | A47D 1/004 297/3 X |
| 4,783,118 | A | * | 11/1988 | Ryan | A47D 1/04 297/3 X |
| 4,929,021 | A | | 5/1990 | Kaye | |
| 5,085,486 | A | * | 2/1992 | Johnson | A47D 13/105 297/3 X |
| 5,112,103 | A | | 5/1992 | Downer | |
| 5,415,454 | A | * | 5/1995 | Fu-Tsung | A47D 1/006 297/3 X |
| 6,000,750 | A | * | 12/1999 | Rossman | A47D 1/004 297/3 X |
| 6,155,641 | A | * | 12/2000 | Frost | A47C 3/20 297/3 X |
| 6,367,874 | B2 | * | 4/2002 | Casini | A47D 1/04 297/3 X |
| 7,553,288 | B2 | | 6/2009 | Cohen | |
| 8,454,094 | B1 | | 6/2013 | Boulware, Sr. | |
| 8,764,116 | B2 | | 7/2014 | Weber et al. | |
| 9,010,867 | B2 | * | 4/2015 | Martin | A47C 3/029 297/462 X |
| 9,179,770 | B2 | | 11/2015 | Turner | |
| 2013/0274080 | A1 | | 10/2013 | Matsushita | |

* cited by examiner

MOVE AND DISCOVER CHAIR

BACKGROUND

An old paradigm for teaching children—essentially "sit" and "get" education—was to have them statically receive education from a teacher positioned at the front of the classroom. Chairs used for this old paradigm were designed for a single orientation with the goal of keeping a child still.

SUMMARY

In one embodiment, a move and discover chair includes a concave end cap with a first side edge and an external concave surface, a convex end cap with a second side edge and an external convex surface, and a center section fixedly positioned between the concave end cap and the convex end cap and with an outer surface that is substantially straight in a directions between the concave end cap and the convex end cap.

In another embodiment, a move and discover chair includes a concave end cap with a first side edge and an external concave surface, a convex end cap with a second side edge and an external convex surface, a two dimensional frame fixedly coupled to both the concave end cap and the convex end cap, and a thin material wrapping around the two dimensional frame to form a seat with a back rest positioned between the concave end cap and the convex end cap.

DETAILED DESCRIPTION OF THE EMBODIMENTS

It was previously thought that in the presence of any kind of distractions, a person would be less able to focus on their learning and their work. It is now thought that some level of movement, balance, fidgeting, and engagement with the background environment can stimulate the ability to focus on learning and to be more effective in one's work. The move and discover chair is made to allow a person to work more efficiently with others in a group environment: rocking toward a partner to better see their work or to make a note on their page or to quickly spin to interact with a different group who are located behind them. In the new education paradigm adopted with this disclosure, where children "move" and "discover" education, a teacher is positioned in the midst of the children, encouraging them in the excitement of learning. A move and discover chair disclosed herein has been designed to help teachers transition from the old paradigm to this new one.

It's been shown that when a person is allowed to fidget and move about, and especially to use their core muscles and vestibular system for balancing, their brain tends to be more available for learning and they tend to become less bored while studying and working compared to when they are sitting still and their bodies are unoccupied. Further, when a person is encouraged to move from one sitting position to another and from one way of looking at the materials they are working with to another, they tend to be more engaged for a longer period of time than when they sit in the same position at the same table and chair. This is especially true for children, and more especially true for young children, and even more especially true for children with learning, behavioral and developmental disabilities. The move and discover chair allows a person to move about, change their orientation, rock around to exercise their vestibular balance, and fidget. The move and discover chair also provides a quick and comfortable platform for them to sit down for a moment or for a longer period of time before they jump up and move off to another area. Bright or varying colors, intriguing sounds, vibrations, and aromas stimulate the senses, while different textures invigorate fidgeting fingers and allow people to keep their brain focused on a particular task for a longer period of time.

Figure 1:
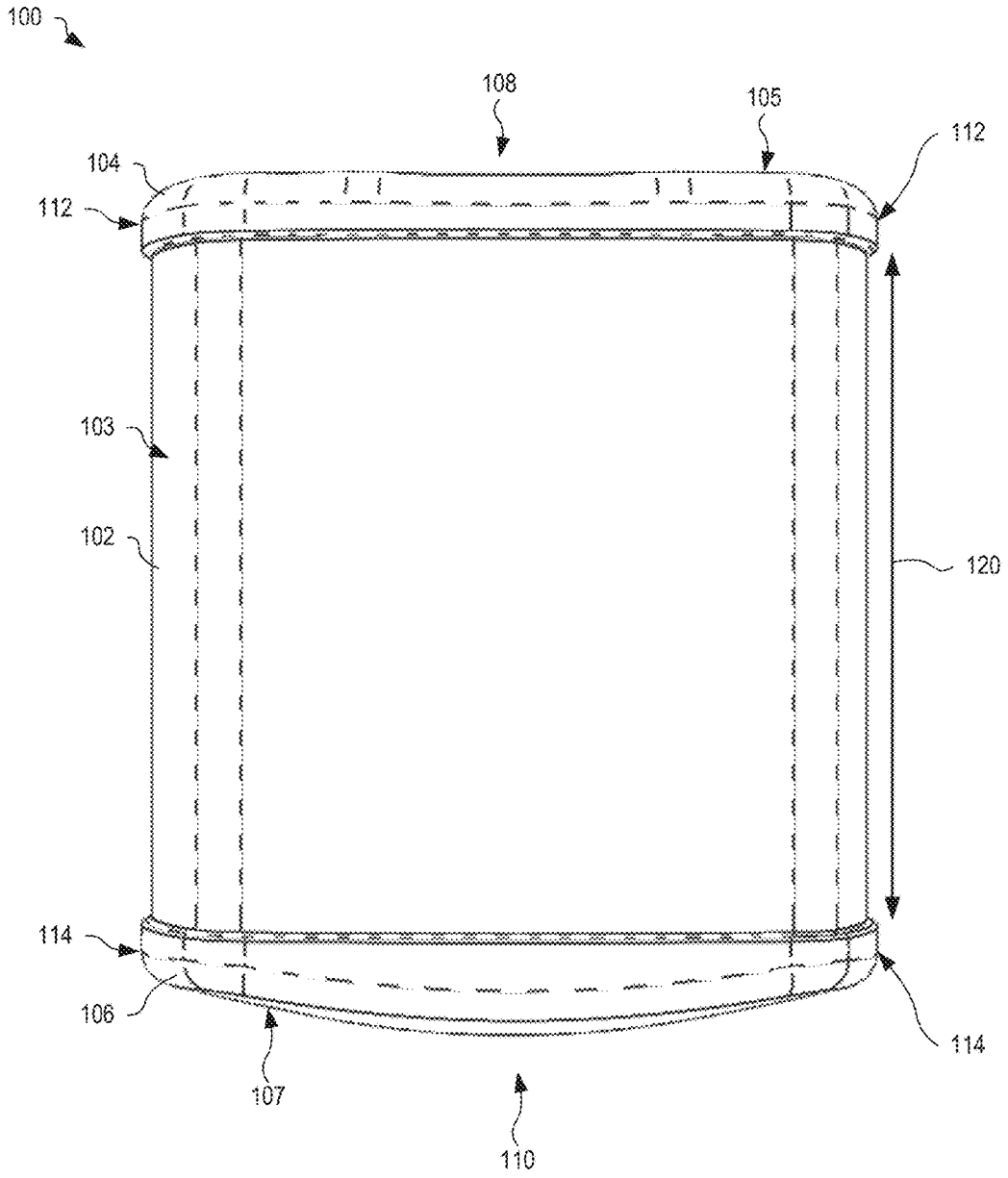
FIG. 1 is a front elevation of a move and discover chair positioned to function as a wobbling stool that rocks in all directions—forward and back, side to side, in an embodiment.
Figure 2:
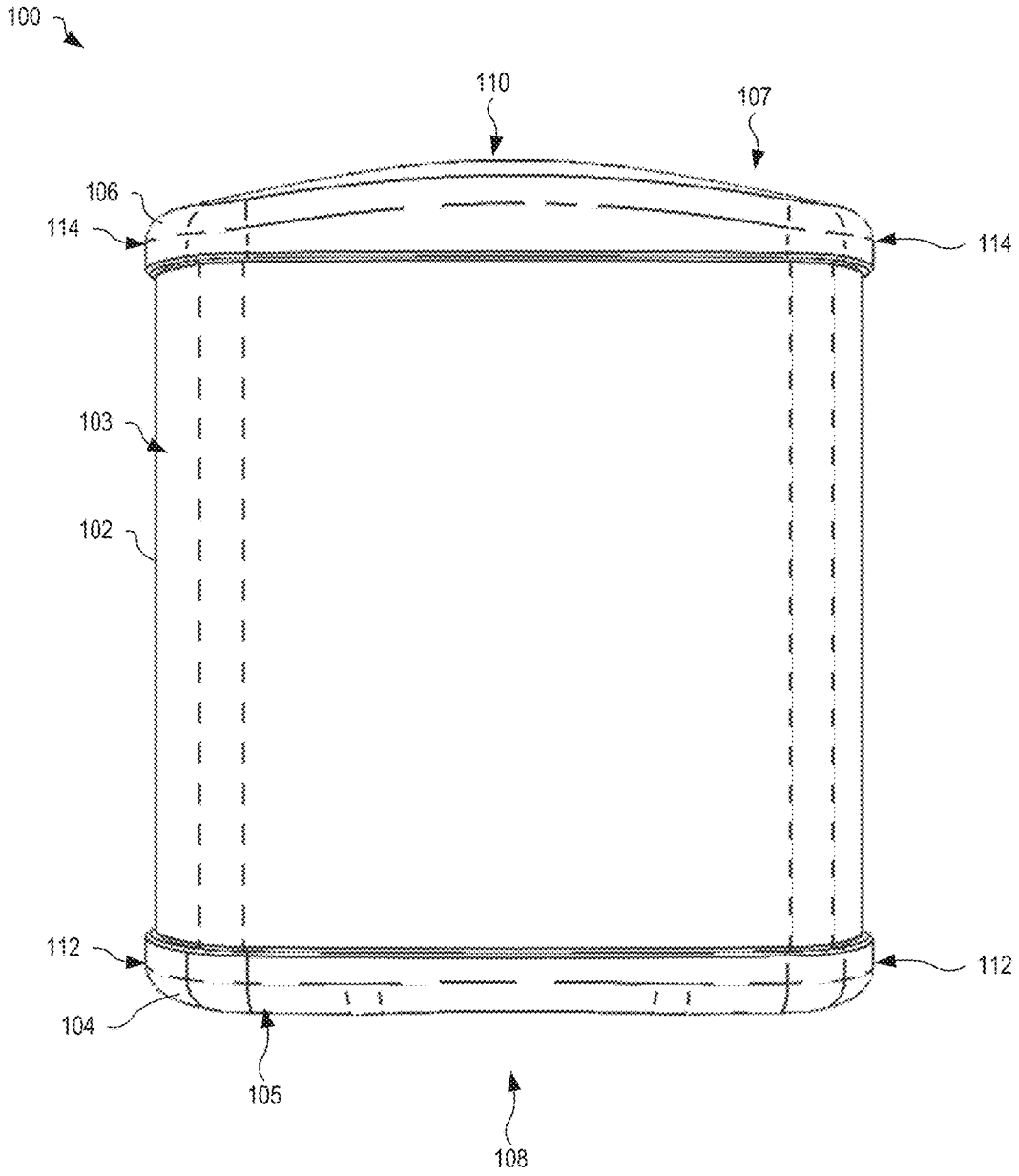
FIG. 2 is a front elevation of the move and discover chair of FIG. 1 positioned to function as a stable stool.
Figure 3:
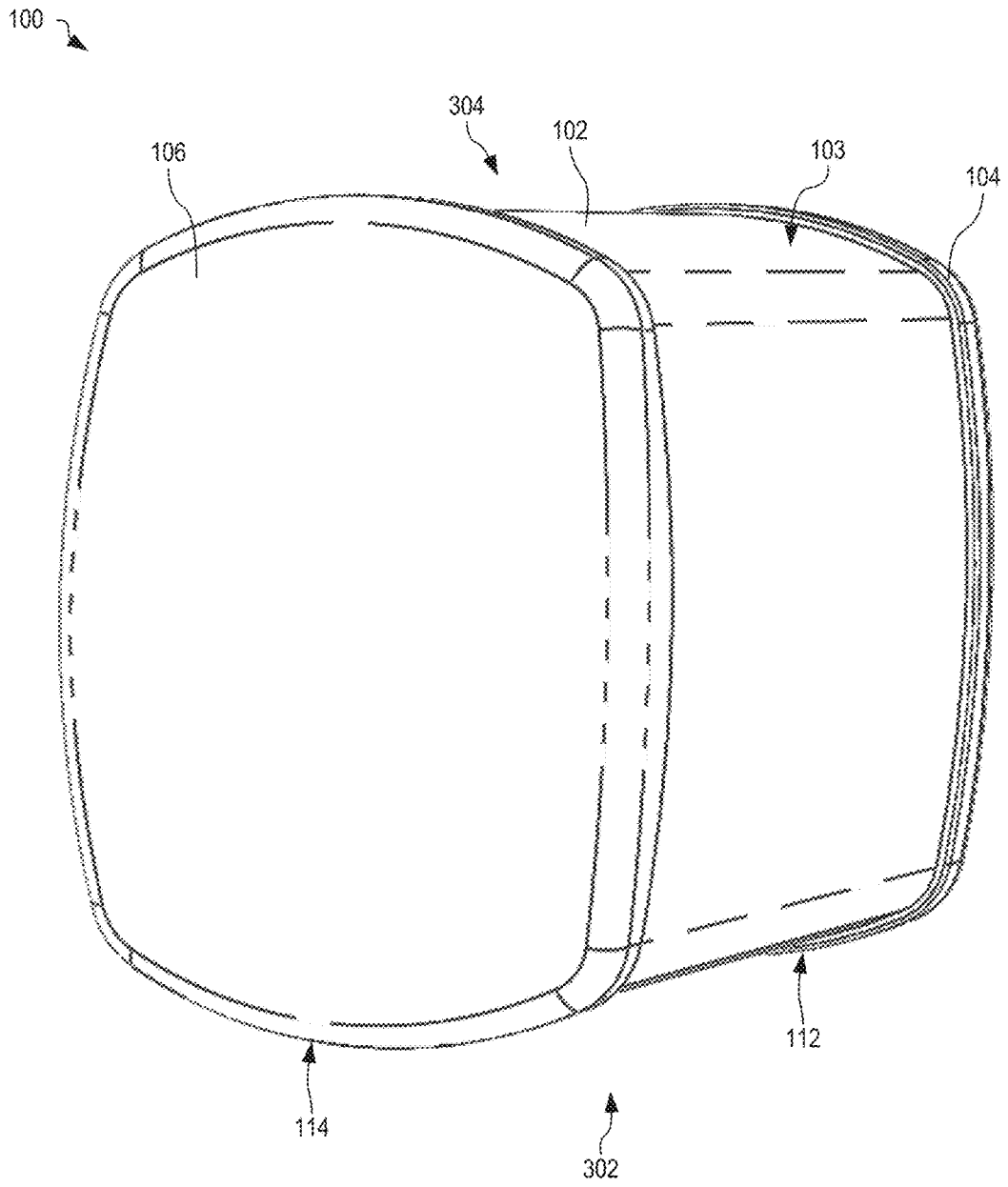
FIG. 3 is a perspective view of the move and discover chair of FIGS. 1 and 2 positioned to function as a rocking saddle stool that rocks side-to-side.
Figure 4:
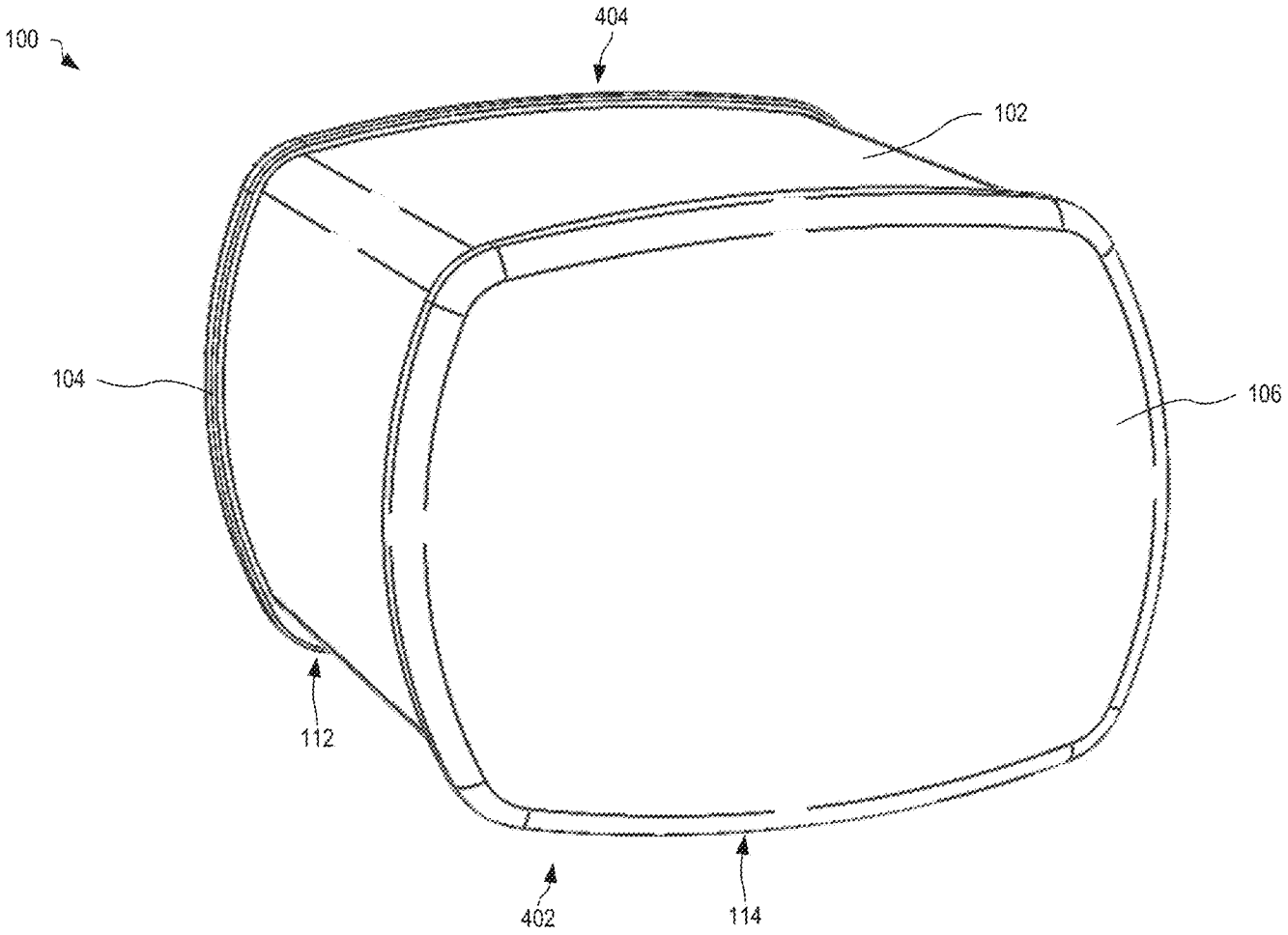
FIG. 4 is a perspective view of the move and discover chair of FIGS. 1-3 positioned to function as a rocking ottoman.
Figure 5:
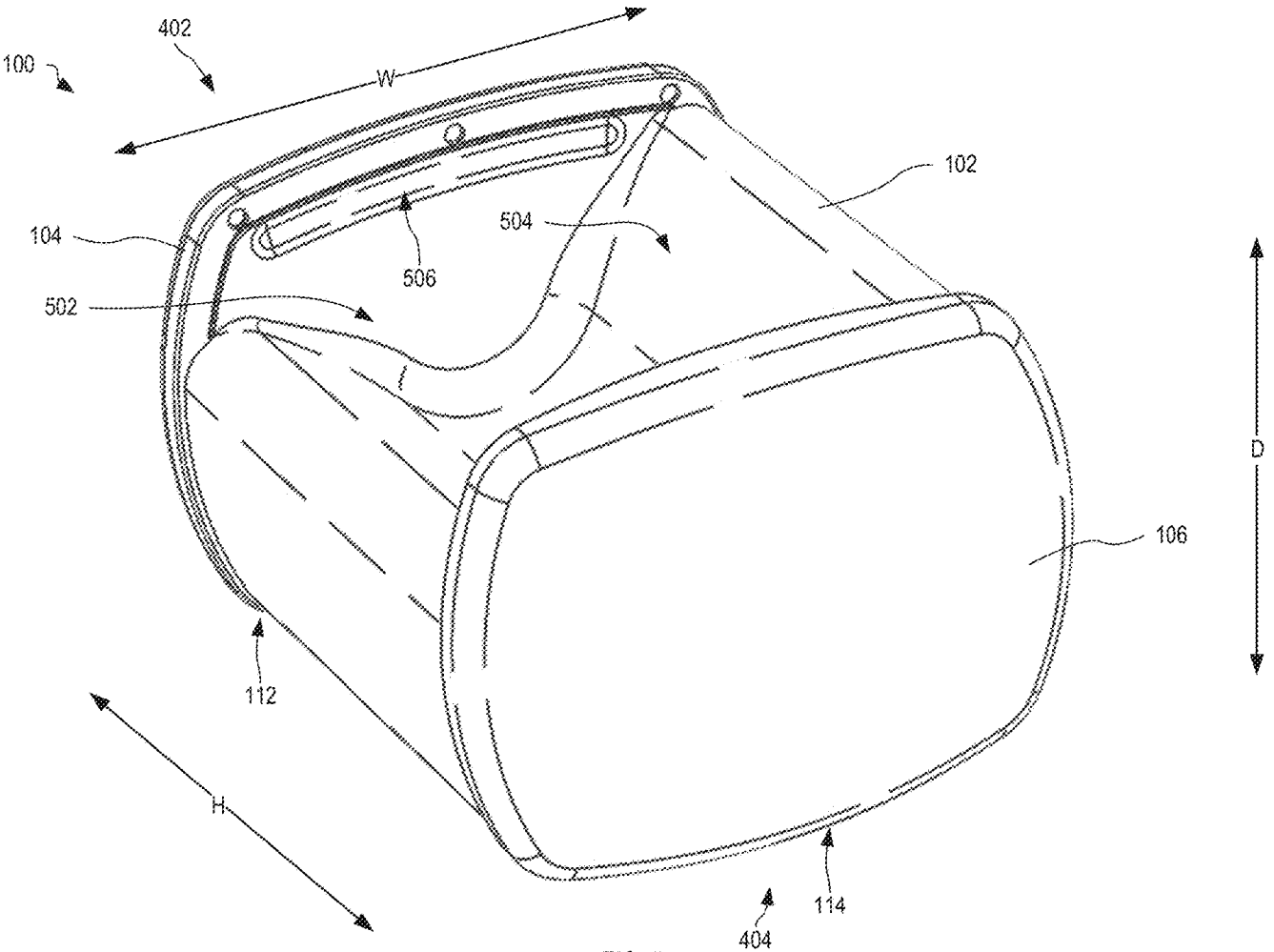
FIG. 5 is a perspective view of the move and discover chair of FIGS. 1-4, positioned to function as a rocking back rest chair.

FIG. 1 is a front elevation of a move and discover chair 100 positioned to function as a wobbling stool. FIG. 2 is a front elevation of move and discover chair 100 of FIG. 1 positioned to function as a stable stool. FIG. 3 is a perspective view of move and discover chair 100 of FIGS. 1 and 2 positioned to function as a rocking saddle stool. FIG. 4 is a perspective view of move and discover chair 100 of FIGS. 1-3 positioned to function as a rocking ottoman. FIG. 5 is a perspective view of move and discover chair 100 of FIGS. 1-4, positioned to function as a rocking back rest chair. FIGS. 1-5 are best viewed with the following description.

Move and discover chair 100 is tub shaped formed of three parts: a central section 102, a concave end cap 104 and a convex end cap 106. In one embodiment, move and discover chair 100 is made as a single component from molded foam or plastic. In another embodiment, move and discover chair 100 is made using two-dimensional frames with a thin material wrapped around the frames to form a seat with back rest shape with a concave end cap and a convex end cap attached at either end of the frame. Central section 102 has a smooth outer surface 103 that is substantially linear in a direction between concave end cap 104 and convex end cap 106. In certain embodiments, central section 102 is formed by extruding a plastic material. In other embodiments, central section 102 is formed (e.g., by one or more of rolling, welding, riveting, screwing, etc.) of a thin material (e.g., aluminum or stainless steel) onto an inner skeletal frame. In other embodiments, a material, such as one or more of woven nylon, rubber, and leather, is stretched between end caps 104 and 106 to form the seat. In certain embodiments, outer surface 103 is textured and/or coated with another material, such as one or more of soft foam, leather, wood, plywood, rubber, paint, and so on.

In some embodiments, move and discover chair 100 is configured with one or more of an endless variety of colors and textures. In one example, move and discover chair 100 is configured with one or more different textures and debossed or embossed shapes (e.g., circle, square, squiggly line, geometrical patterns of shapes, animal shapes, letters, numbers, and symbols) in different areas. These textures may be explored by fingers of the person sitting in move and discover chair 100.

Concave end cap 104 has an outer surface 105 with a central concave portion 108. Concave end cap 104 may be made of a foam rubber, or similar, material, such as by injection molding or other such processes. Concave end cap 104 may be formed with a channel (not shown) shaped to receive an end of central section 102. Concave end cap 104 fixedly attaches (e.g., using adhesive or mechanical means) to central section 102. Outer surface 105 of concave end cap 104 may be smooth, textured, and/or coated with a material such as paint.

Convex end cap 106 has an outer surface 107 with a central convex portion 110. Convex end cap 106 may be made of a foam rubber, or similar, material, such as by injection molding or other such processes. Convex end cap 106 may be formed with a channel (not shown) shaped to receive an end of central section 102. Convex end cap 106 fixedly attaches (e.g., using adhesive or mechanical means) to central section 102. Outer surface 107 of convex end cap 106 may be smooth, textured, and/or coated with a material such as paint.

Concave end cap 104 and convex end cap 106 are sized such that when move and discover chair 100 is positioned as shown in FIGS. 3, 4 and 5, edges 112, 114 of concave end cap 104 and convex end cap 106, respectively, support move and discover chair 100 and central section 102 does not touch the ground. Since edges 112, 114 are curved, move and discover chair 100 may rock when supported by edges 112, 114 on a flat surface (e.g., a floor).

Move and discover chair 100 is configured to allow a child to easily move from area to area within a classroom, post up and move on again as needed. For example, move and discover chair 100 is light weight and allows the child to easily and quickly change from working on a desk, to carry it over to a quieter place to sit down in a corner to read, and back again. As shown in FIG. 5, each end cap 104, 106 has a recess 506 proximate one side of edges 112, 114, respectively, within sitting recess 502. These recesses 506 facilitate holding of edges 112 and 114 to move chair 100. Move and discover chair 100 also allows a child to move in different ways while they are working and learning. Movement allowed by move and discover chair 100 improves their vestibular balance, allows for fidgeting and "getting their wiggles out". Move and discover chair 100 is also advantageous for challenged children (e.g. ADD/ADHD/Autism, etc.) as it is believed that rocking alleviates some of the hold that these challenges place upon the child.

Figure 6:
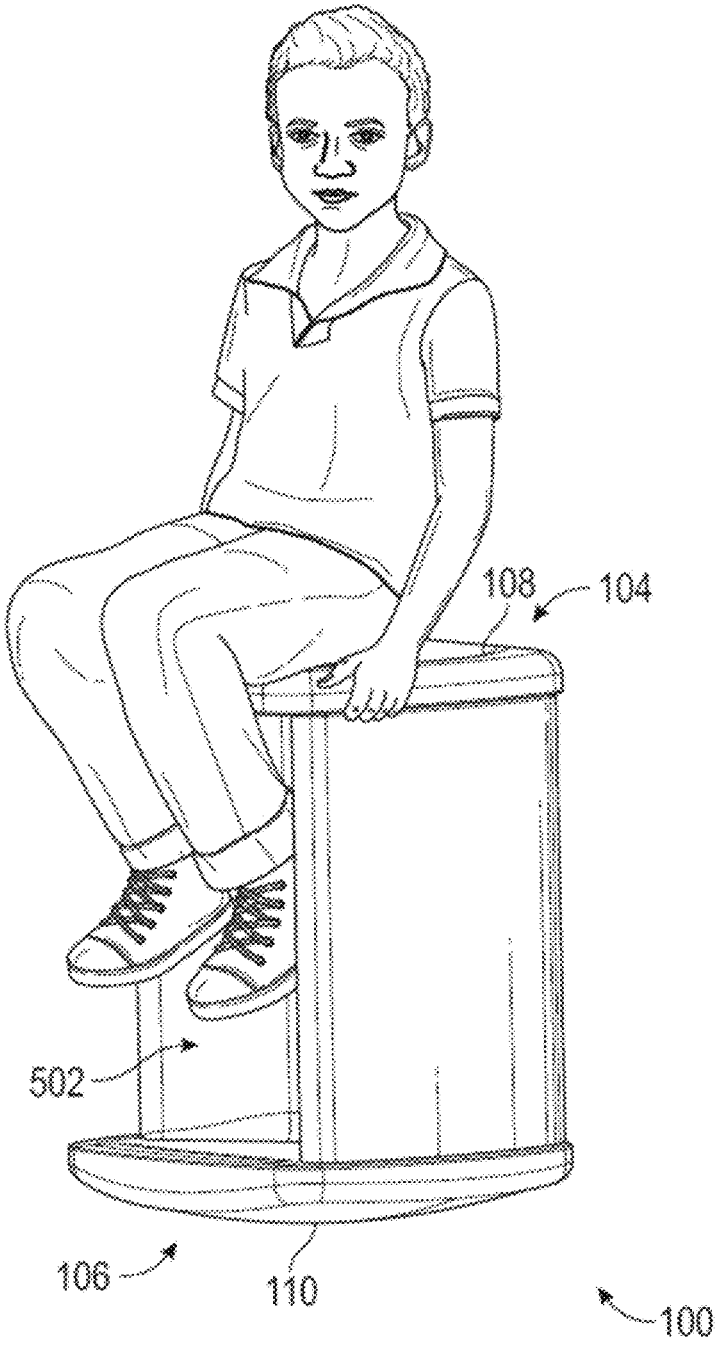
FIG. 6 is a perspective view showing an example of a child using the move and discover chair of FIG. 1 as a wobbling stool.
Figure 7:
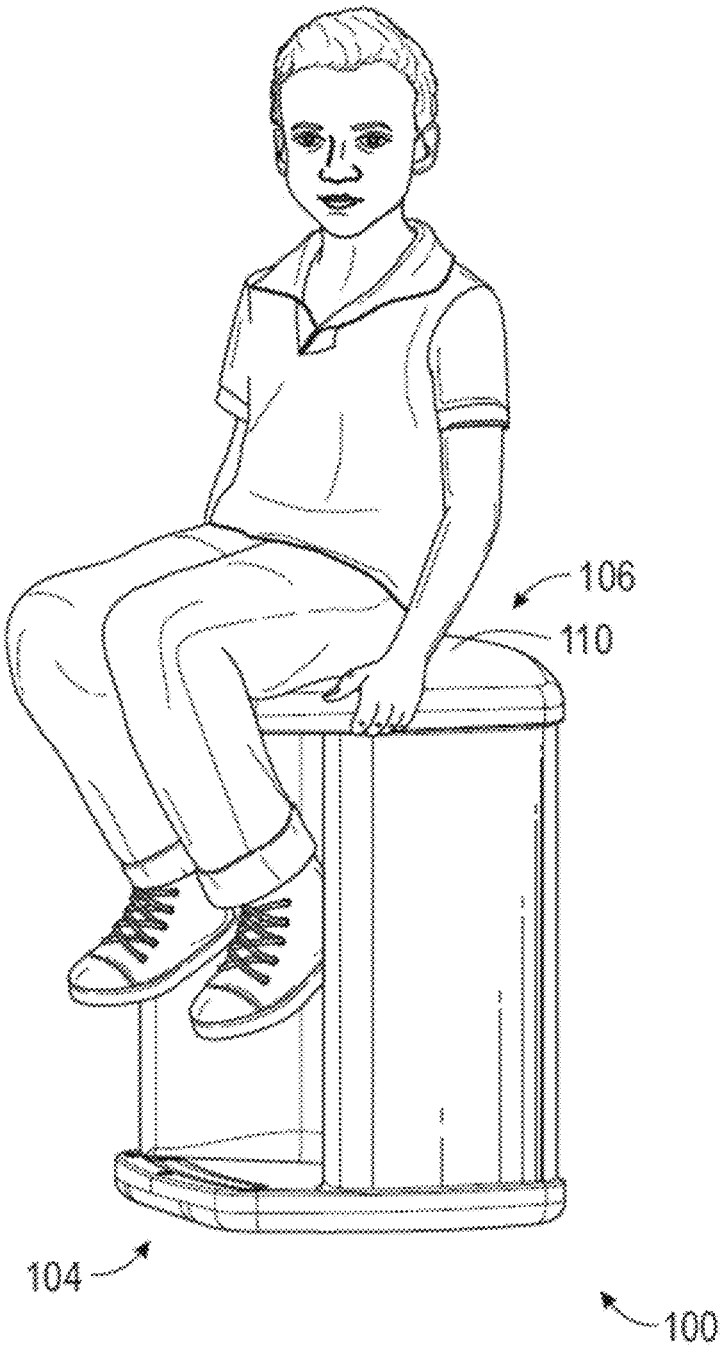
FIG. 7 is a perspective view showing an example of a child using the move and discover chair of FIG. 2 as a stable stool.
Figure 8:
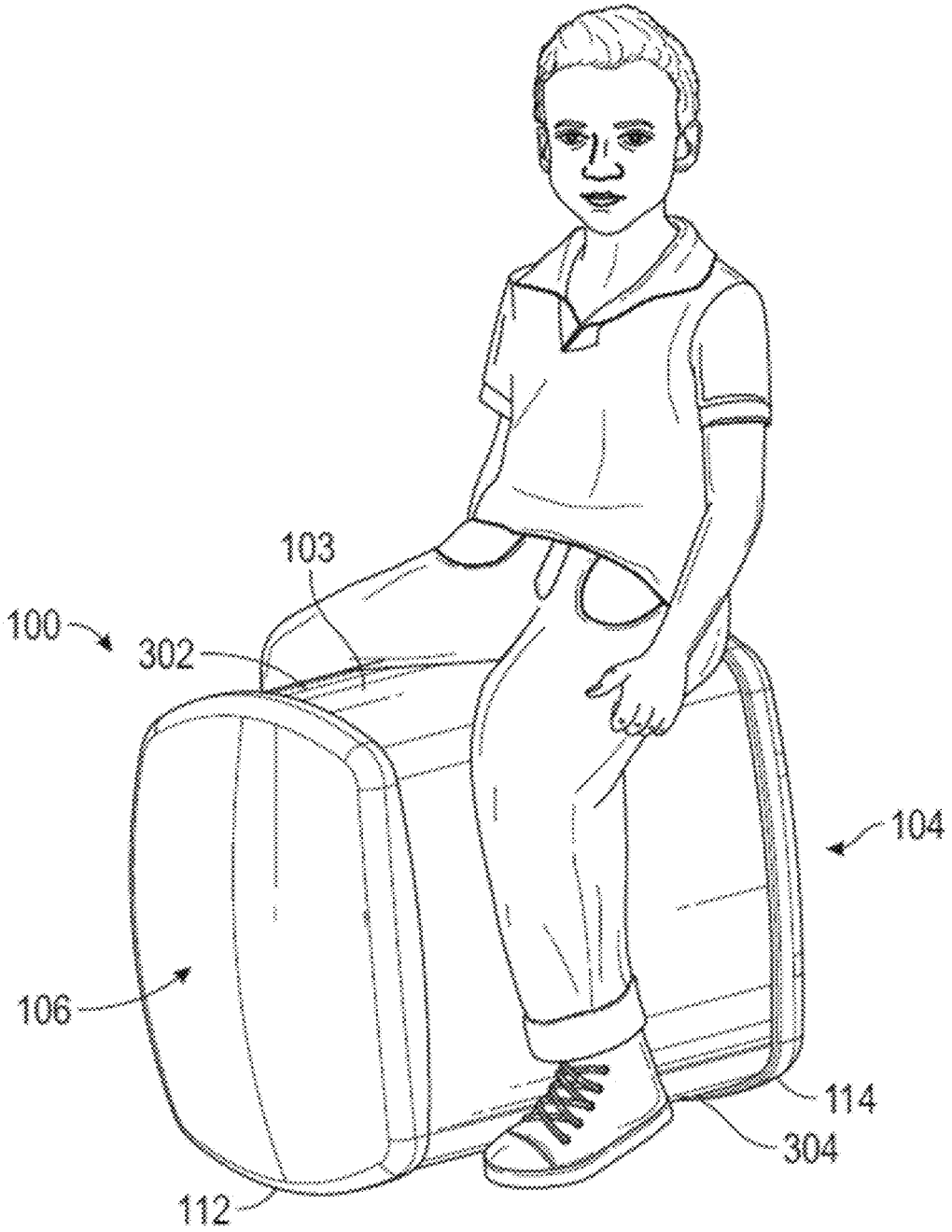
FIG. 8 is a perspective view showing an example of a child using the move and discover chair of FIG. 3 as a rocking saddle stool.
Figure 9:
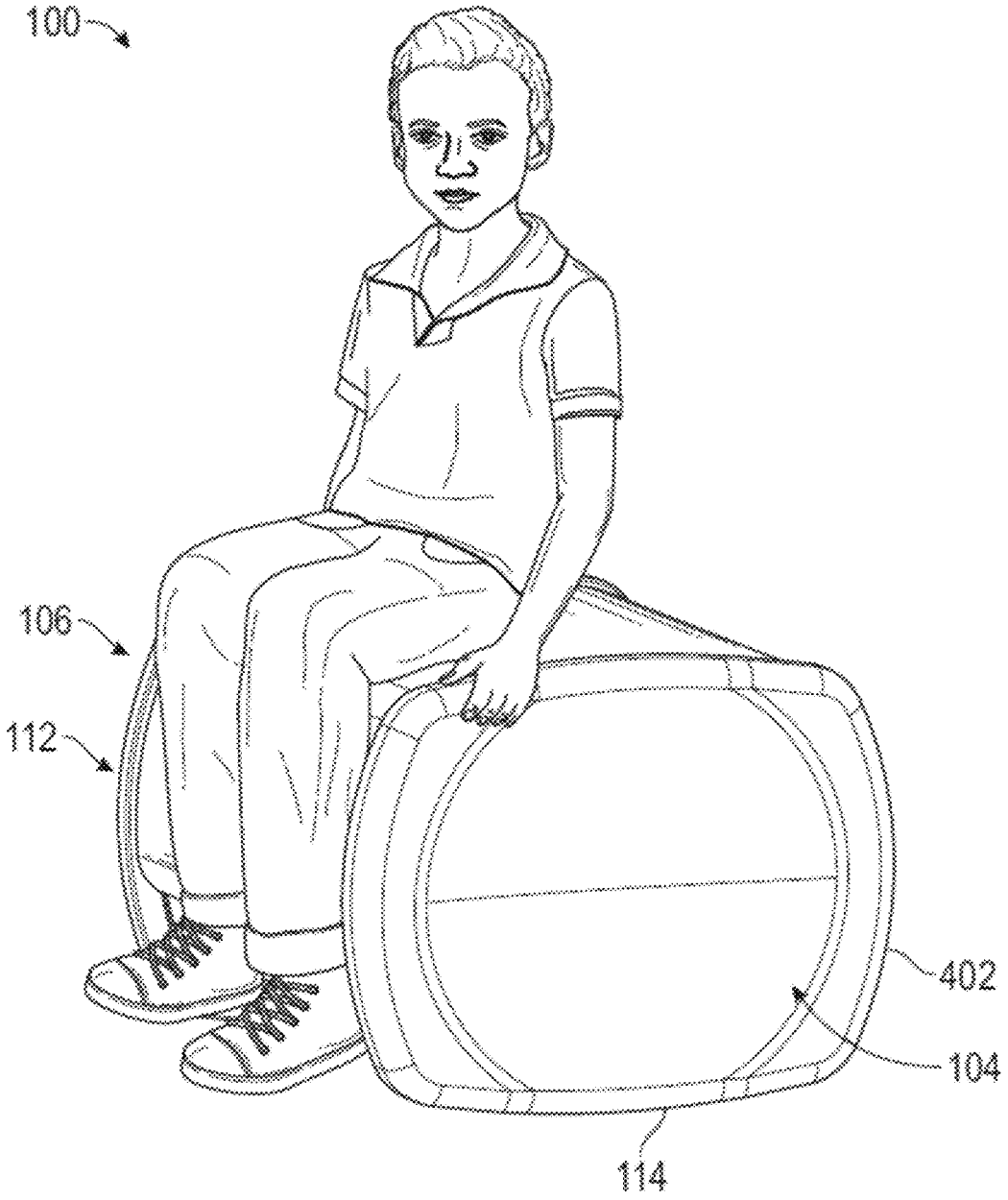
FIG. 9 is a perspective view showing an example of a child using the move and discover chair of FIG. 4 as a rocking ottoman.
Figure 10:
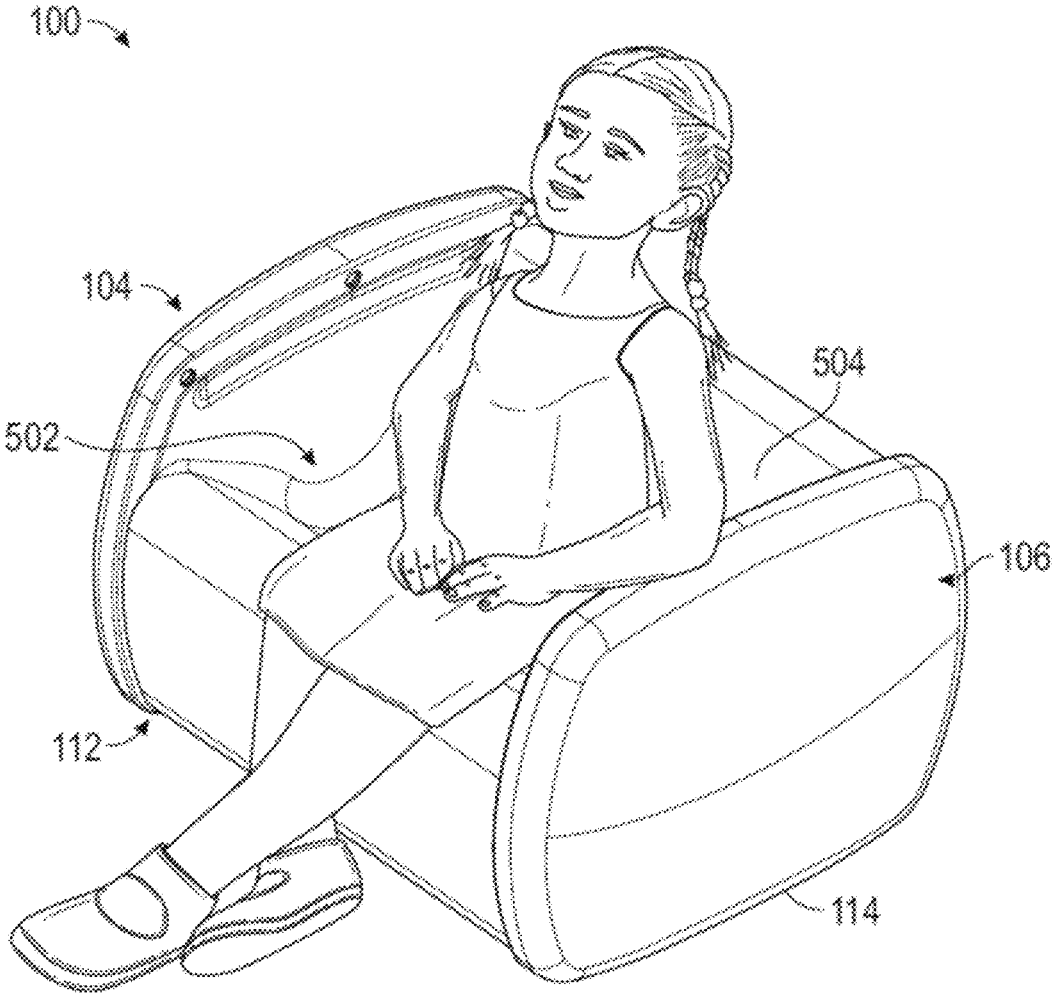
FIG. 10 is a perspective view showing an example of a child using the move and discover chair of FIG. 5 as a rocking back rest chair.

Move and discover chair 100 is configured to operate in any of five basic orientations: wobbling stool, stable stool, rocking saddle stool, rocking ottoman, and rocking back rest chair. FIG. 6 is a perspective view showing an example of a child using the move and discover chair of FIG. 1 as a wobbling stool. FIG. 7 is a perspective view showing an example of a child using the move and discover chair of FIG. 2 as a stable stool. FIG. 8 is a perspective view showing an example of a child using the move and discover chair of FIG. 3 as a rocking saddle stool. FIG. 9 is a perspective view showing an example of a child using the move and discover chair of FIG. 4 as a rocking ottoman. FIG. 10 is a perspective view showing an example of a child using the move and discover chair of FIG. 5 as a rocking back rest chair. Example use of each orientation is described in detail below. However, many other orientations may be found through use and experimentation by a child.

Children have minds that naturally explore their environment, and move and discover chair 100 allows a child to experiment freely. For example, beyond the envisaged uses of move and discover chair 100 for simple sitting, children have used it in unforeseen ways, such as laying down across them, on the floor leaning back against them, as a short desk while they sit crisscross on the floor, as an ottoman as they sit on another chair.

Wobbling Stool

As shown in FIGS. 1 and 6, where move and discover chair 100 is positioned to stand on convex end cap 106, concave end cap 104 is uppermost, allowing a child to sit on central concave portion 108. In this orientation, move and discover chair 100 introduces an instability that exercises the vestibular balance of the child, while allowing them to rock in every direction. When sitting on central concave portion 108 of concave end cap 104, the child may tuck their legs and feet into a sitting recess 502 (see FIG. 5) that allows them to keep their center of gravity over a point where central convex portion 110 of convex end cap 106 touches the ground. When collaboratively working with their feet on the floor, the move and discover chair 100 allows the child to lean over and be involved in the collaboration.

Stable Stool

By inverting the move and discover chair 100 to have concave end cap 104 on the ground, as shown in FIGS. 2 and 7, the move and discover chair 100 is stable and a child may sit on central convex portion 110 of convex end cap 106, which allows the child to swivel themselves around easily. This allows the child, when working in the middle of a group for example, to turn and interact with people positioned around them without the need to move chair 100.

Rocking Saddle Stool

Move and discover chair 100 may be positioned to stand on curved edges 112 and 114 of concave end cap 104 and convex end cap 106, respectively, at a narrow side 302 of move and discover chair 100, as shown in FIGS. 3 and 8. This allows a child to sit on outer surface 103 at an opposite side 304 of central section 102. When the child straddles move and discover chair 100, with one leg on either side of central section 102, the child may rock from side to side. When a child sits with both legs on the same side of move and discover chair 100, the child may rock forward and backward.

Rocking Ottoman

Move and discover chair 100 may be positioned to stand on curved edges 112 and 114 of concave end cap 104 and convex end cap 106, respectively, at a wide side 402 of move and discover chair 100, as shown in FIGS. 4 and 9. In this orientation, sitting on move and discover chair 100 is more like sitting on an ottoman. Move and discover chair 100 allows a child to rock forwards and backwards (or side to side depending on how the child is sitting).

Rocking Back Rest Chair

Move and discover chair 100 may be positioned to stand on curved edges 112 and 114 of concave end cap 104 and convex end cap 106, respectively, at a wide side 404 of move and discover chair 100, as shown in FIGS. 5 and 10, where sitting recess 502 is uppermost. In this orientation, move and discover chair 100 operates as a short rocking chair with a short back rest 504 that supports only the lower back of a child and reclines the child backwards slightly. While sitting, with only lower back support, the child is required to use their core muscles in a subtle and not uncomfortable way.

Example Dimensions

Dimensions of move and discover chair 100 are selected based upon the size of the expected user. For example, the height H of move and discover chair 100 in the wobbling stool orientation correlates directly to a seat width 120 in the rocking back rest chair orientation. Thus, the height of the wobbling stool orientation correlates to the width of the hips of the expected user, especially when sized for use by adults. For example, for adults, a seat width 120 of about eighteen inches fits a large percentage of the population comfortably and provides a wobbling stool orientation that has a height of about twenty-two inches, which is a little taller than the seat height of a normal chair, but is quite comfortable when the user rests their feet on the inside surface of concave end cap 104, such that their heels are positioned within sitting recess 502.

For children of two to five years of age, a seat width 120 of ten and one-half inches is suitable, which results in a height of fourteen and one-half inches for move and discover chair 100 in the wobbling stool orientation. The move and discover chair 100 has a width W of fifteen inches and a depth D of twelve inches. For children of six to seven years of age, move and discover chair 100 has a seat width 120 of thirteen inches, resulting in a height H of seventeen inches for the wobbling stool orientation, a width W of fifteen inches and a depth D of twelve inches. For children of eight to ten years of age, move and discover chair 100 has a seat width 120 of fifteen and one-half inches and a height H of nineteen and one-half inches for the wobbling stool orientation, a width W of fifteen inches and a depth D of twelve inches.

However, it should be appreciated that move and discover chair 100 may have other dimensions without departing from the scope hereof.

Additional Features

Figure 11:
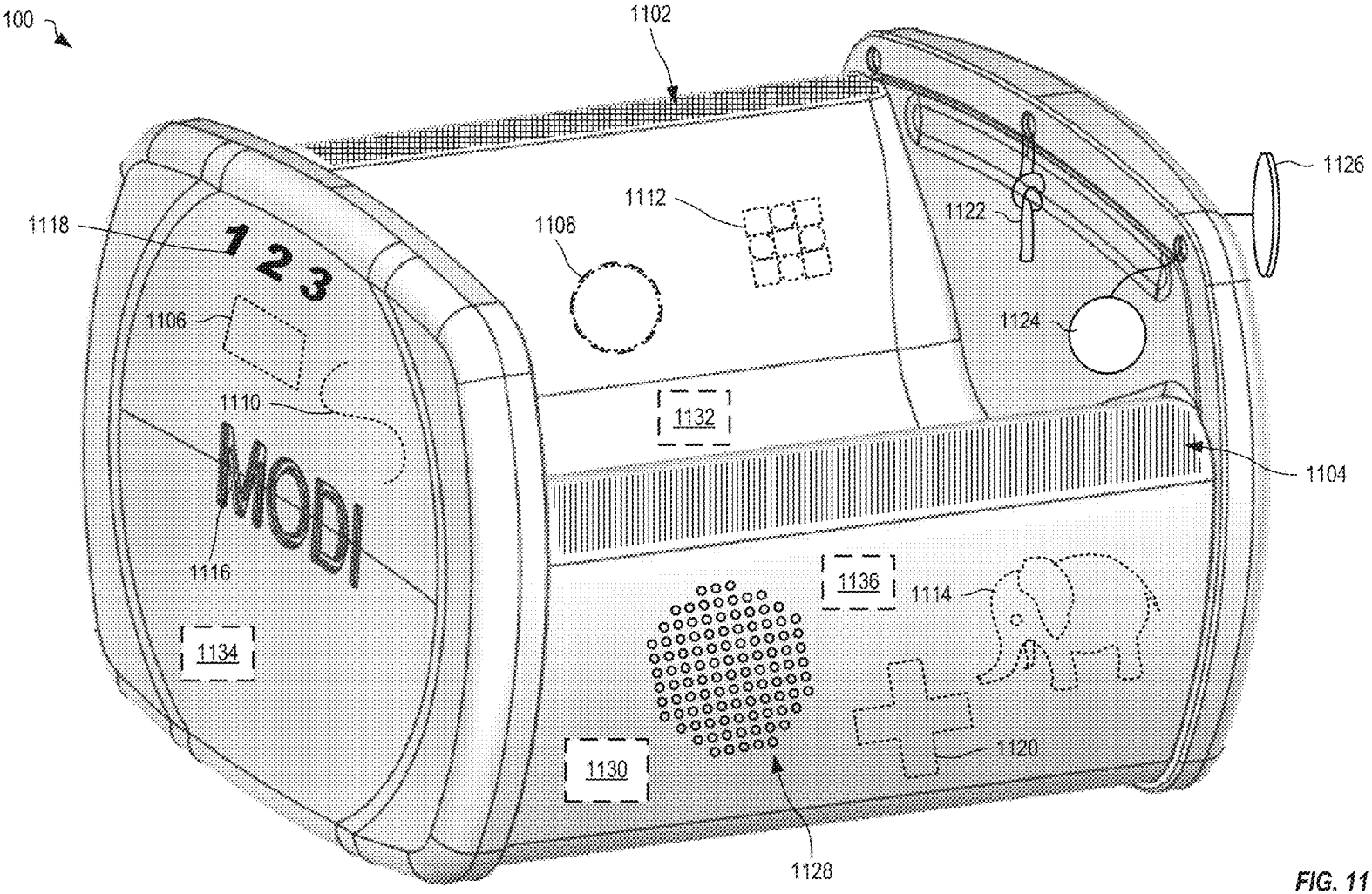
FIG. 11 shows the move and discover chair of FIGS. 1-5 configured with various additional features, in embodiments.

FIG. 11 shows move and discover chair 100 of FIGS. 1-5 configured with various additional features. In some embodiments, move and discover chair 100 is configured with one or more of an endless variety of colors 1102 and textures 1104. In one example, move and discover chair 100 is configured in different areas with one or more different textures 1104 and debossed or embossed shapes, for example such as square 1106, circle 1108, squiggly line 1110, geometrical patterns of shapes 1112, animal shapes 1114, letters 1116, numbers 1118, and symbols 1120. These textures may be explored by fingers of the person sitting in or on move and discover chair 100. In one example of operation, move and discover chair 100 is used by a child and provides the child with textures 1104, square 1106, circle 1108, squiggly line 1110, geometrical patterns of shapes 1112, animal shapes 1114, letters 1116, numbers 1118, and symbols 1120 debossed or embossed such that fingers of the child may fidget while the mind of the child remains engaged on a particular task for a longer period of time as compared to that of a child sitting on a conventional chair.

In another embodiment, move and discover chair 100 includes one or more attachments that may be explored by the person sitting on the chair. For example, move and discover chair 100 may include a rope with a knot 1122, a stretchy rubber ball 1124, a spinning wheel 1126, etc. In one example of operation, move and discover chair 100 is used by a child and allows fingers of the child to fidget with one or more of rope with knot 1122, stretchy rubber ball 1124, and spinning wheel 1126, thereby increasing the period that the mind of the child remains engaged on a particular task as compared to that of a child sitting on a conventional chair.

In other embodiments, move and discover chair 100 may include devices that stimulate other senses of the person sitting in the chair. For example, move and discover chair 100 may include a sound generator (e.g., a speaker 1128 and driving electronics 1130) that may generate white noise and/or soothing sounds from outdoor environments, and/or music and/or intriguing sounds. In another embodiment, move and discover chair includes an actuator 1132 (e.g., a vibrating mechanism) that's imparts vibration to the chair that may be felt by the person sitting in the chair. In another embodiment, move and discover chair 100 has one or more lights 1134 (e.g., LEDs) that are incorporated into the chair and operate to make one or more portions of the chair glow with different and/or changing colors. In another embodiment, move and discover chair 100 includes an accessory 1136 that couples with the chair and emits an aroma.

Summary of Advantages

The embodiments of the move and discover chair disclosed herein have the following advantages:

- allows a person to fidget and move about, and especially to use their core muscles and vestibular system for balancing, such that their brain tends to be more available for learning and they tend to become less bored while studying and working compared to when they are sitting still and their bodies are unoccupied.
- encourages a person to move from one sitting position to another and from one way of looking at the materials they are working with to another, so that they will tend to be more engaged for a longer period of time than when the sit in the same position at the same table and chair.
- specifically designed for children, and more especially for young, elementary age children.
- specifically designed for children with learning, behavioral and developmental disabilities.
- allows a person to move about, change their orientation, rock around and exercise their vestibular balance, and fidget.
- provides a quick and comfortable platform for a person to sit down for a moment or for a longer period of time before they jump up and move off to another area.
- stimulate senses using bright or varying colors, intriguing sounds, vibrations, and aromas.
- invigorate fidgeting fingers using textures to allow people to keep their brain focused on a particular task for a longer period of time.
- light and easy to move, made as a single component from molded foam or plastic.
- made by two dimensional frames with a thin material wrapped around the frames to form the extruded seat with back rest shape with a concave end cap and a convex end cap attached on either end.
- woven nylon, rubber or leather is stretched across from end cap to end cap to form the seat.
- can be textured and/or coated with another material, such as soft foam, leather, wood, plywood, rubber, paint, and so on.
- the central section can be formed by extruding a plastic material.

the central section can be formed by rolling and welding or riveting or screwing a thin material, such as aluminum or stainless steel onto an inner skeletal frame.

can be made in an endless variety of colors and textures.

can be made to have different textures and debossed or embossed shapes (e.g., circle, square, squiggly line, geometrical patterns of shapes, animal shapes, letters or numbers or other symbols) in different areas to allow the fingers of the person sitting in the chair to fidget with the different textures.

can be made to have pieces (e.g., a rope with a knot, a stretchy rubber ball, a spinning wheel, etc.) attached to the chair so that a person can fidget with these pieces.

can be made with items that appeal to other senses of a person:

with speakers within the chair so that a person can listen to white noise or soothing sounds from outdoor environments, or music, with vibrating mechanisms incorporated into the chair, with lights within the chair that make it glow different colors, and with accessories that plug into the chair to emit different aromas.

Changes may be made in the above methods and systems without departing from the scope hereof. For example, move and discover chair 100 may include any one or more of the above described features 1102-1136 in any combination without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A move and discover chair, comprising:

a concave end cap having a first side edge and an external concave surface;

a convex end cap having a second side edge and an external convex surface; and a center section fixedly positioned between the concave end cap and the convex end cap and having an outer surface that is substantially straight in a direction between the concave end cap and the convex end cap;

the convex end cap providing wobbling support for the move and discover chair when oriented to stand thereon, the concave end cap providing a concave surface for sitting on.

2. A move and discover chair, comprising:

a concave end cap having a first side edge and an external concave surface;

a convex end cap having a second side edge and an external convex surface;

a center section fixedly positioned between the concave end cap and the convex end cap and having an outer surface that is substantially straight in a direction between the concave end cap and the convex end cap; and a sound generator for generating sounds audible to a user of the chair, the generated sounds being selected from the group including white noise, intriguing sounds, soothing sounds from outdoor environments, and music.

3. A move and discover chair, comprising:

a concave end cap having a first side edge and an external concave surface;

a convex end cap having a second side edge and an external convex surface;

a center section fixedly positioned between the concave end cap and the convex end cap and having an outer surface that is substantially straight in a direction between the concave end cap and the convex end cap; and an actuator for imparting vibration to the chair, the vibration being selected to intrigue a user.

4. A move and discover chair, comprising:

a concave end cap having a first side edge and an external concave surface;

a convex end cap having a second side edge and an external convex surface;

a center section fixedly positioned between the concave end cap and the convex end cap and having an outer surface that is substantially straight in a direction between the concave end cap and the convex end cap; and at least one light source for illuminating at least part of the chair with changing color.

5. A move and discover chair, comprising:

a concave end cap having a first side edge and an external concave surface;

a convex end cap having a second side edge and an external convex surface;

a center section fixedly positioned between the concave end cap and the convex end cap and having an outer surface that is substantially straight in a direction between the concave end cap and the convex end cap; and an attachment for emitting an aroma.

6. A move and discover chair, comprising:

a concave end cap having a first side edge and an external concave surface;

a convex end cap having a second side edge and an external convex surface; and a center section fixedly positioned between the concave end cap and the convex end cap and having an outer surface that is substantially straight in a direction between the concave end cap and the convex end cap;

the center section having an outer surface coated with a material selected from the group including soft foam, leather, wood, plywood, rubber, and paint.

7. A move and discover chair, comprising:

a concave end cap having a first side edge and an external concave surface;

a convex end cap having a second side edge and an external convex surface; and a center section fixedly positioned between the concave end cap and the convex end cap and having an outer surface that is substantially straight in a direction between the concave end cap and the convex end cap;

the center section being formed by extruding a plastic material.

8. A move and discover chair, comprising:

a concave end cap having a first side edge and an external concave surface;

a convex end cap having a second side edge and an external convex surface; and a center section fixedly positioned between the concave end cap and the convex end cap and having an outer surface that is substantially straight in a direction between the concave end cap and the convex end cap;

the center section being formed by one or more of rolling, welding, riveting, and screwing a thin material onto an inner skeletal frame, the thin material being selected from the group including aluminum and stainless steel.

* * * * *